US006702172B1

(12) United States Patent
Håkansson

(10) Patent No.: US 6,702,172 B1
(45) Date of Patent: Mar. 9, 2004

(54) STAPLE DRIVER WITH CONVEX EDGE AND POINTED PROTRUSIONS AT THE ENDS

(75) Inventor: Eskil Håkansson, Hestra (SE)

(73) Assignee: Isaberg Rapid AB, Hestra (SE)

( * ) Notice: Subject to any disclaimer, the term of this patent is extended or adjusted under 35 U.S.C. 154(b) by 0 days.

(21) Appl. No.: 10/110,939

(22) PCT Filed: Oct. 11, 2000

(86) PCT No.: PCT/SE00/01960

§ 371 (c)(1),
(2), (4) Date: May 6, 2002

(87) PCT Pub. No.: WO01/36162

PCT Pub. Date: May 25, 2001

(30) Foreign Application Priority Data

Nov. 19, 1999 (SE) ..... 9904179

(51) Int. Cl.[7] ..... B25C 5/02
(52) U.S. Cl. ..... 227/155; 227/82; 227/119
(58) Field of Search ..... 227/155, 82, 88, 227/119, 134

(56) References Cited

U.S. PATENT DOCUMENTS

| | | | | |
|---|---|---|---|---|
| 2,066,157 A | | 12/1936 | Pankonin | |
| 3,524,575 A | | 8/1970 | Hurkmanse et al. | 227/7 |
| 4,375,866 A | * | 3/1983 | Giersch et al. | 227/85 |
| 4,747,531 A | | 5/1988 | Brinkerhoff et al. | 227/19 |
| 4,811,884 A | * | 3/1989 | Sato | 227/155 |
| 5,044,540 A | * | 9/1991 | Dulebohn | 227/82 |
| 5,080,275 A | * | 1/1992 | Heimerl et al. | 227/82 |
| 5,941,440 A | * | 8/1999 | Ohmae et al. | 227/88 |
| 6,056,183 A | * | 5/2000 | Tanabe | 227/155 |
| 6,257,477 B1 | * | 7/2001 | Straat et al. | 227/88 |

FOREIGN PATENT DOCUMENTS

| | | |
|---|---|---|
| EP | 0 780 196 | 6/1997 |
| SE | 506 725 | 2/1998 |
| SE | 511 482 | 10/1999 |

* cited by examiner

*Primary Examiner*—Scott A. Smith
(74) *Attorney, Agent, or Firm*—Miles & Stockbridge P.C.

(57) ABSTRACT

A staple driver (9) is provided, which is adapted to be mounted in a stapler for driving staples into a sheaf of papers (11) in order to drive, in a striking motion, the legs of a U-shaped staple (10) through the sheaf of papers (11). The driver (9) has a plate-shaped portion (13) with an edge surface (14) which is arranged, in the striking motion, to be applied and pressed against the web portion of the staple (10). The staple driver (9) has pointed projections (12) which are arranged to engage, in the striking motion, with the web portion of the staple (10) in front of the legs of the staple. The edge surface (14) of the driver (9) extends in its longitudinal direction along an outwardly curved arc.

6 Claims, 2 Drawing Sheets

STAPLE DRIVER WITH CONVEX EDGE AND POINTED PROTRUSIONS AT THE ENDS

BACKGROUND OF THE INVENTION

1. Field of the Invention

The present invention relates to a staple driver which is adapted to be mounted in a stapler for driving staples into a sheaf of papers to eject a U-shaped staple and drive its legs through the sheaf of papers in a striking motion, the striking motion being directed perpendicular to the web portion of the staple, said driver having a plate-shaped portion with an edge surface whose width is essentially equal to the thickness of the staple and which is arranged, in the striking motion, to be applied and pressed against the web portion of the staple.

2. Description of Related Art

In prior-art staplers, use is made of a magazine which either contains straight wire staple blanks which are juxtaposed and releasably interconnected to form a strip of staple blanks, or contains U-shaped staples which are arranged closely together in a long row. In the former case, the stapler has a shaper as well as a driver. As stapling is carried out by means of the stapler, the strip of staple blanks is advanced step by the step to the shaper which in a striking motion shapes the straight staple blank, which is in a shaping position, to a U-shaped staple. This U-shaped staple is advanced by the step-by-step advancing of the strip to a driving position in front of the driver, which in a striking motion releases the staple from the strip and drives its legs into a sheaf of papers. In the latter case, i.e. when the magazine contains U-shaped staples, shaping need, of course, not take place. The stapler then has no shaper but a driver which operates in the fashion described above.

A prior-art driver and the manner in which it drives a U-shaped staple into a sheaf of papers will now be described with reference to FIGS. 1A–1F.

FIGS. 1A–1F show a portion of a staple driver 1 which consists of a metal plate having essentially the same thickness as the U-shaped staple 2 which is to be driven into a sheaf of papers 3. The driver 1 is arranged in a stapler (not shown) reciprocating in the direction of the double arrow P1.

The staple driver 1 has at its side edges projections 4 projecting in the direction of the staple 2. The projections 4 are pointed and each located in front of one of the two legs 2" of the staple 2 arranged in the driving position, so as to engage with the web portion 2' of the staple 2 in front of the legs 2" as the staple 2 is being driven in. The driver 1 also has a portion 5 located between the projections 4 and having an edge surface 6 facing the staple 2.

The stapler also has a clinching mechanism which comprises two clinching means 7 each of which is turnable on a pivot 8 which is perpendicular to the plane of the staple 2, and each of which is arranged to cooperate with a leg 2" of the staple 2.

When the staple driver 1 in a striking motion is moved in the direction of the staple 2, its two pointed projections 4 will engage with the web portion 2' of the staple 2 in front of the legs 2". The projections 4 bite into the web portion 2', the edge surface 6 of the portion 5 of the driver 1 being applied and pressed against the web portion 2' in order to drive, during the continued striking motion of the driver 1, the legs 2" through the sheaf of papers 3 until the web portion 2' comes into abutment against the upper side thereof (see FIG. 1C). When the staple legs 2" are driven through the sheaf of papers 3, they strike against the clinching means 7 arranged in a first turning position and are bent slightly towards each other (see FIG. 1C). The driver 1 is retained in the position shown in FIG. 1C, and the clinching means 7 are turned to a second turning position (FIG. 1D) while they bend the staple legs 2" further into abutment against the underside of the sheaf of papers 3, i.e. to a position in which the legs 2" extend parallel with the sheaf of papers 3. Subsequently the clinching means 7 are turned back to the first turning position while the driver 1 is retained in its position with the edge surface 6 pressed against the web portion 2' of the staple 2 (FIG. 1E). Finally, the driver 1 is returned to its starting position shown in FIGS. 1A and 1F.

When the staple 2, as is usually the case, is made of a metal wire, it can, after completion of driving and clinching, be deformed somewhat in that the staple legs 2" spring out a distance from the underside of the sheaf of papers 3 in the manner shown in FIG. 1F. This results in the staple 2 obtaining a considerably greater thickness, seen in the driving direction of the staple, than in the clinched position shown in FIG. 1E. This increase in thickness is of course not desirable. For instance, it causes trouble when a plurality of sheaves of an arbitrary number of stapled sheets of paper are inserted in a file since the thickness of the entire sheaf will be considerably much greater in the upper left corner where the staples are usually arranged when stapling together sheets of paper. Moreover, there is a great risk of the user being torn by the projecting leg ends.

The object of the present invention is to provide, in view of that stated above, a staple driver which eliminates the above problems caused by the resilience properties of the staple material.

SUMMARY OF THE INVENTION

According to the invention, this object is achieved by a staple driver, which is of the type mentioned by way of introduction, being given the distinctive features defined in claim 1, i.e. that in combination with the feature known per se that the staple driver has pointed projections which are arranged to engage, in the striking motion, with the web portion of the staple in front of the legs of the staple, it has the feature that the edge surface in its longitudinal direction extends along an outwardly curved arc.

The edge surface preferably is of essentially the same length as the web portion of the staple and is preferably arcuate over its entire length.

BRIEF DESCRIPTION OF THE DRAWINGS

The invention will now be described in more detail with reference to the accompanying drawings, in which.

DETAILED DESCRIPTION OF THE PREFERRED EMBODIMENTS

Figure 1A:
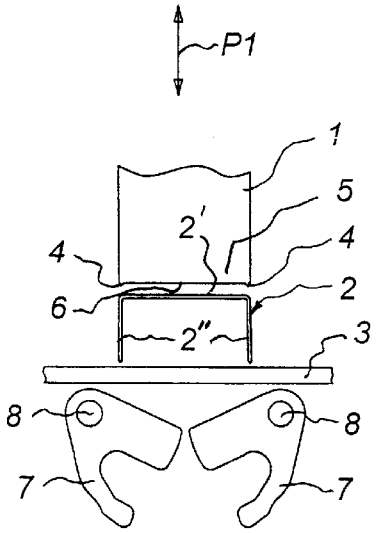
FIG 1A PRIOR ART
FIGS. 1A–1F show a portion of the prior-art staple driver described above.
Figure 1B:
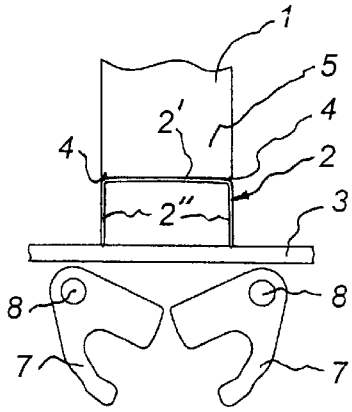
FIG 1B PRIOR ART
Figure 1C:
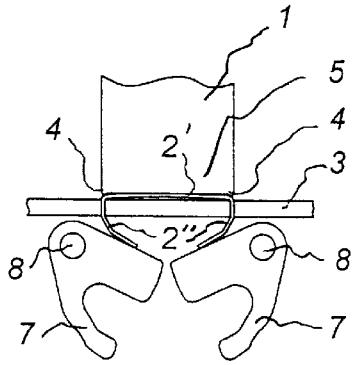
FIG 1C PRIOR ART
Figure 1D:
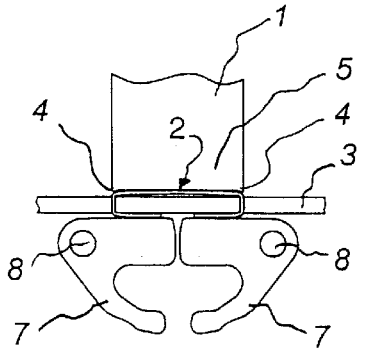
FIG 1D PRIOR ART
Figure 1E:
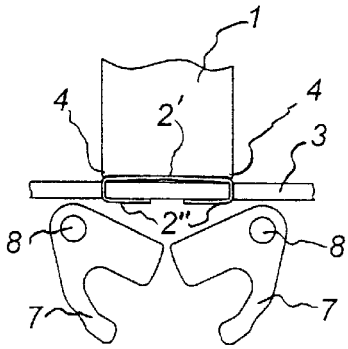
FIG 1E PRIOR ART

The staple driver 9 of which a portion is shown in FIGS. 2A–2F consists of a metal sheet which has essentially the same thickness as the U-shaped staple 10 which is made of metal wire and which is to be driven into a sheaf of papers 11. The driver 9 is arranged in a stapler (not shown) reciprocating in the direction of the double arrow P2.

The staple driver 9 has at its side edges projections 12 projecting in the direction of the staple 10. The projections 12 are pointed and each positioned in front of one of the two legs 10" of the staple 10 located in the driving position, in order to engage with the web portion 10' of the staple 10 in front of the legs 10", when driving in the staple 10. The driver 9 also has a portion 13, which is located between the projections 12 and has an edge surface 14 facing the staple 10. The edge surface 14 has essentially the same length as the web portion 10' of the staple 10 and extends in its longitudinal direction along an outwardly curved arc. In the shown, preferred embodiment, the edge surface 14 is arcuate over its entire length.

The stapler also has a clinching mechanism which comprises two clinching means 15 which are turnable on a pivot 16 each, which is perpendicular to the plane of the staple 10, and are each arranged to cooperate with one of the legs 10" of the staple 10.

Figure 2A:
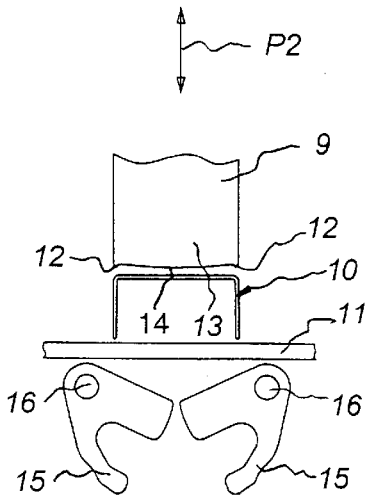
FIGS. 2A–2F illustrate a portion of a staple driver according to the present invention.
Figure 2B:
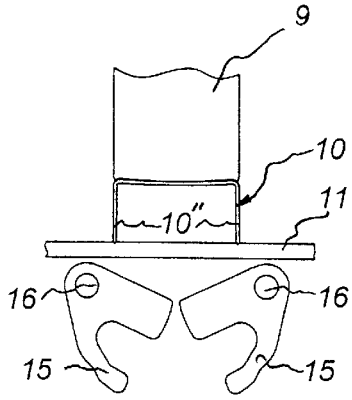
Figure 2C:
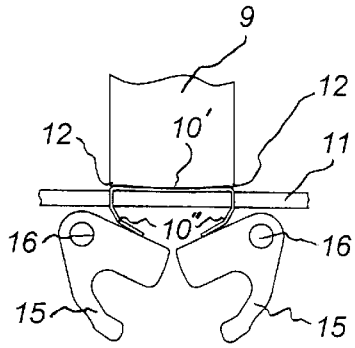
Figure 2D:
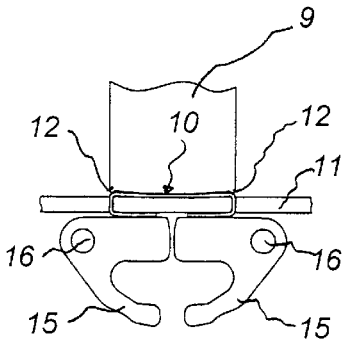
Figure 2E:
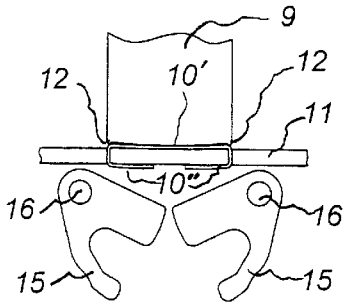

When the staple driver 9 in a striking motion is moved in the direction of the staple 10, its two pointed projections 12 will engage with the web portion 10' of the staple 10 in front of the legs 10". The projections 12 bite into the web portion 10', the edge surface 14 of the portion 13 of the driver 9 being applied and pressed against the web portion 10' in order to drive, during the continued striking motion of the driver 9, the legs 10" through the sheaf of papers 11 until the web portion 10' comes into abutment against the upper side thereof (see FIG. 2C). The web portion 10' of the staple 10 will then be given the arcuate shape defined by the edge surface (see FIGS. 2C–2E). When the legs 10" are driven through the sheaf of papers 11, they strike against the clinching means 15 placed in a first turning position and are bent slightly towards each other (see FIG. 2C). The driver 9 is retained in the position shown in FIG. 2C and the clinching means 15 are turned to a second turning position (FIG. 2D) while they bend the staple legs 10" further into abutment against the underside of the sheaf of papers 11, i.e. to a position in which the legs 10" extend parallel with the sheaf of papers 11. Subsequently, the clinching means 15 are turned back to the first turning position while the driver 9 is retained in its position with the edge surface 14 pressed against the web portion 10' of the staple 10 (FIG. 2E). Finally, the driver 9 is returned to the starting position shown in FIGS. 2A and 2F.

Figure 1F:
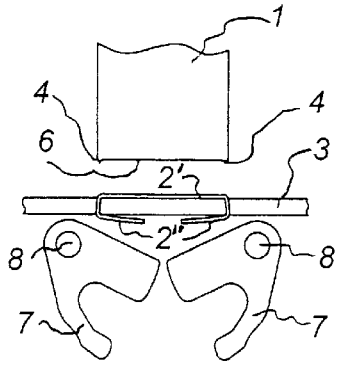
FIG 1F PRIOR ART
Figure 2F:
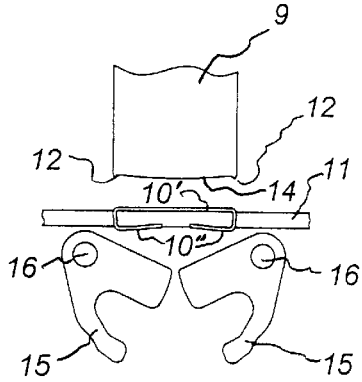

When the staple driver 9 has left the staple 10 which has been driven in and clinched, the web portion 10' thereof springs back and becomes straight while at the same time the staple legs 10" at their free ends are pressed a distance into the sheaf of papers 11 at the underside thereof (see FIG. 2F). As a result, the above-described outwards springing of the staple legs from the underside of the sheaf of papers does not take place, in contrast to the prior-art staple driver (see FIG. 1F).

What is claimed is:

1. A staple driver for use in a stapler having a clinching device which bends legs of a U-shaped staple of the type having a web portion and two legs depending from said web portion, said staple driver comprising:

a plate-shaped portion having an edge surface, a width of said edge surface being essentially equal to a thickness of a staple to be driven;

a pair of pointed projections disposed at outer ends of said edge surface, said pointed projections being spaced apart at a distance such that they are arranged to engage the web portion of the staple substantially directly above the legs of the staple, and wherein a portion of said edge surface between said pair of pointed projections is shaped as an outwardly curved arc.

2. A staple driver as claimed in claim 1, wherein the edge surface is arcuate over its entire length between said pair of pointed projections.

3. A stapler for driving staples into a sheaf of papers, comprising:

a staple driver so constructed and arranged to eject a U-shaped staple having a web portion and two legs, and to drive said legs of said staple through a sheaf of papers in a striking motion, a clinching device constructed to bend the legs of said staple upon being driven through a sheaf of papers, wherein a striking motion of said staple driver is directed perpendicular to said web portion of said staple, wherein said staple driver has a plate-shaped portion with an edge surface, a width of said edge surface being essentially equal to a thickness of said staple, and which is arranged, in the striking motion, to be applied and pressed against the web portion of the staple, and wherein the staple driver has pointed projections which are so constructed and arranged to engage, in the striking motion, the web portion of the staple substantially directly above the legs of the staple, and said edge surface of said staple driver is of essentially the same length as the web portion of the staple, and is curved in an outward arc along a longitudinal direction between said pointed projections.

4. A stapler as claimed in claim 1, wherein the edge surface of the staple driver is arcuate over its entire length.

5. A stapler for driving staples into a sheaf of paper, comprising:

a staple driver so constructed and arranged to eject a U-shaped staple, said staple having a substantially straight web portion of a predetermined length and having two legs depending from outer ends of said web portion, said staple driver further being so constructed and arranged to drive said legs of said staple through a sheaf of papers in a striking motion, a clinching device constructed to bend the legs of said staple upon being driven through a sheaf of papers, said clinching device being operable to bend free ends of said legs into abutment against an underside of said sheaf of papers, wherein a striking motion of said staple driver is directed perpendicular to said web portion of said staple, wherein said staple driver has a plate-shaped portion with an edge surface, a width of said edge surface being essentially equal to a thickness of said staple, and which is arranged, in die striking motion, to be applied and pressed against the web portion of the staple, and wherein said edge surface of said staple driver is of essentially the sonic length as the web portion of the staple, and wherein the staple driver has pointed projections which are so constructed and arranged to engage, in the striking motion, the web portion of the staple substantially directly above the legs of the staple, and wherein at least a portion of said edge surface extending between said pointed projections is curved man outward arc to thereby bend said web portion of said staple into a curved shape during said striking motion of said staple driver, whereby, upon completion of said striking motion, said web portion springs back toward its initial substantially straight shape, causing said free ends of said staple legs to move into tight engagement with said underside of said sheaf of papers.

6. A method for stapling a sheaf of papers comprising:

positioning a U-shaped staple at a desired position relative to an upper surface of said sheaf of papers, said staple having a substantially straight web portion of a predetermined length and having two legs depending therefrom, moving a staple driver toward said staple in a striking motion, said staple driver having a plate-shaped portion with an edge surface, a width of said edge surface being essentially equal to a thickness of said staple, and a length of said edge surface being of essentially the same length as the web portion of the stapler, said edge portion further having a pointed projection at each end thereof, and at least a section of said edge portion between said pointed projections being curved in an outward arc, engaging said web of said staple With said pointed projections, in a continuation of said striking motion, driving said legs of said staple through a thickness of said sheaf of papers bending s free end of each of said legs protruding past a lower surface of said sheaf of papers, such that said free ends contact said lower surface, bending at least a section of said web portion of said staple with said section of said edge portion having said outwardly curved shape, and releasing said staple driver from said web portion of said staple, whereby a bent section of said web springs back toward its initial shape, causing said free ends of said legs to move into tight engagement with said lower surface of said sheaf of papers.

* * * * *